United States Patent [19]

Brookfield

[11] Patent Number: 4,502,223

[45] Date of Patent: Mar. 5, 1985

[54] HAND TOOL WITH TOOTHED ROTORS FOR DISLODGING MATERIAL FROM A SURFACE

[76] Inventor: Peter A. M. Brookfield, 7/16 Atkin Ave., Mission Bay, Auckland, New Zealand

[21] Appl. No.: 435,307

[22] Filed: Oct. 19, 1982

[30] Foreign Application Priority Data

Oct. 19, 1981 [NZ] New Zealand ..... 198688

[51] Int. Cl.[3] ..... A47L 13/08; B26F 1/32

[52] U.S. Cl. ..... 30/365; 30/366; 30/172; 15/236 R

[58] Field of Search ..... 30/365, 366, 307, 292, 30/172; 172/349; 15/236 R

[56] References Cited

U.S. PATENT DOCUMENTS

| | | | |
|---|---|---|---|
| 633,465 | 9/1899 | Mertes | 172/349 |
| 2,435,349 | 2/1948 | Hall | 30/365 |
| 2,471,763 | 5/1949 | Merrick | 30/365 |
| 2,471,793 | 5/1949 | Merrick | 30/365 |
| 3,123,911 | 3/1964 | Snyder | 30/172 |
| 3,281,938 | 11/1966 | Lee | 30/365 |
| 3,389,466 | 6/1968 | Parris | 30/366 |
| 3,514,854 | 6/1970 | Norfleet | 30/365 X |
| 3,763,563 | 10/1973 | Ott | 30/365 |
| 4,072,197 | 2/1978 | Dunlop | 172/349 |
| 4,274,202 | 6/1981 | Petrick | 30/365 |

FOREIGN PATENT DOCUMENTS

| | | | |
|---|---|---|---|
| 77267 | 8/1892 | Fed. Rep. of Germany | 30/365 |
| 22540 | of 1913 | United Kingdom . | |

*Primary Examiner*—Jimmy C. Peters

*Attorney, Agent, or Firm*—Young & Thompson

[57] ABSTRACT

A scarifying tool has a plurality of modules, each module consisting of a pair of cutter discs with bevelled teeth, rotatably mounted at an angle to the direction of travel to provide a sideways tearing action on the material to be dislodged as the discs are moved along the surface of the roof. Each module is mounted independently, to provide an independent suspension having several degrees of freedom. Adjustable depth control is provided by moving the discs relative to substrate contacting members to vary the depth of penetration of the cutters below the skids.

11 Claims, 12 Drawing Figures

FIG. 2
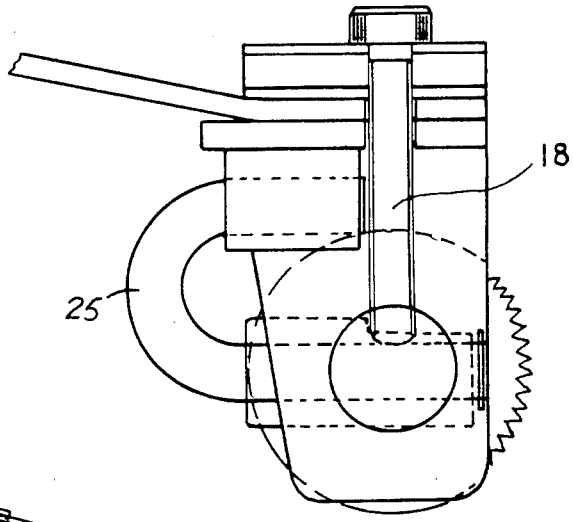
FIG. 3
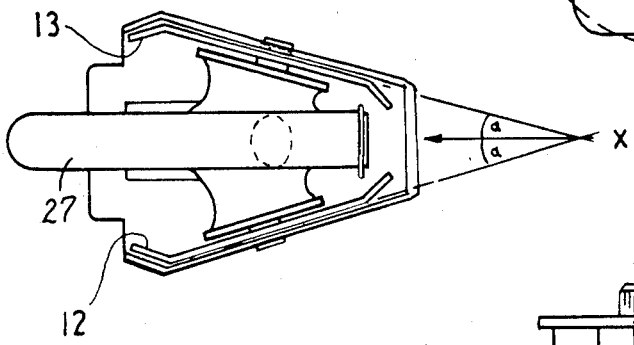
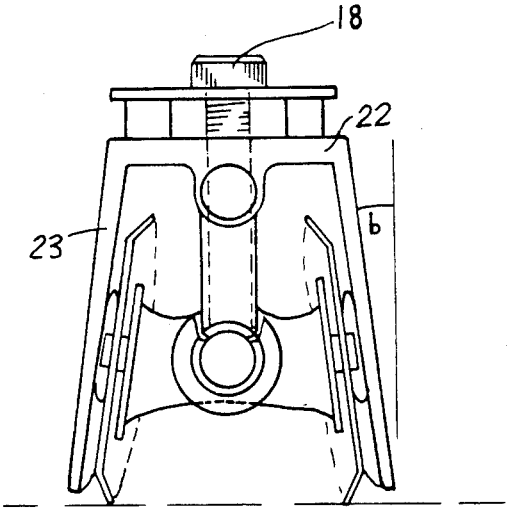
FIG. 4

HAND TOOL WITH TOOTHED ROTORS FOR DISLODGING MATERIAL FROM A SURFACE

BACKGROUND OF THE INVENTION

This invention relates to surface breaking or scarifying tools having rotatable rollers, discs, or cutters capable of being moved over a surface to be cut or scratched. Such scarifying tools are used to perforate wallpaper.

In removing wallpaper, it is desirable to perforate or scratch the surface of the wallpaper to allow water or steam to penetrate the surface of the wallpaper to reach the glue or adhesive adhering the wallpaper to a wall. Generally, such tools have consisted of cutter wheels or spiked rollers, illustrated by the following patents:

U.K. Pat. No. 22540 of 1912,

U.S. Pat. No. 3,389,466, to Parris,

U.S. Pat. No. 2,435,349 to Hall,

U.S. Pat. No. 3,514,814 to Norfleet,

U.S. Pat. No. 4,274,202 to Petrick.

The latter patent assigned to Bonumwerke Tigges and Winckel GmbH & Co.KG, shows a pair of spiked rollers having needle points mounted on elongate rollers, with the pair of rollers inclined to one another in such a way that if the tool is moved over the surface of wallpaper, each spike performs two motions similtaneously. That is the motion resulting from rotation of the roller, and at an angle thereto, the overall motion of the device. This results in an elongated slot-like hole in the surface of the wallpaper rather than the pin pricks achieved by rotation of a single roller. The mounting of the pair of rollers, is such that if the wall surface is not particularly flat the roller on the high spots will bite more firmly into the wall and will also tend to control the movement of the device. It will wish to move in a direction normal to the axis of rotation of the roller on that side. When correcting pressure is applied to the other side, again there will be uneven depth of pricking and the movement will be in the other direction. This has not only the undesirable effect of causing the device to move in wavy lines, but also reduces the efficiency of the scratching process, because if one side "takes control", the spikes on that side will prick the wallpaper only leaving pin pricks rather than the elongate slot-like holes. In addition, the tool described in the Petrick patent has to be held at a fixed angle to the wall if all of the spikes are to contact the surface as the tool is moved along the wall. It will be readily appreciated that changing the angle of the handle relative to the wall will cause the tool to pivot about those spikes which are distant from the handle, thereby allowing the remainder of the spiked rollers to lift clear of the surface. This limits the usefulness of the tool, and with the necessity for a levelling guide makes it difficult to operate the tool in confined areas.

Another tool showing a pair of inclined rollers is U.S. Pat. No. 4,224,726 which teaches the use of pivotally mounted inclined rollers made up of star wheels to pull a carpet seam together.

U.S. Pat. No. 976,496 to Reiser describes a paper cutter using a pair of inclined meshing cutting wheels to cut a single score line to facilitate separation of the cut paper into two portions.

SUMMARY OF THE INVENTION

It is an object of this invention to provide an improved tool capable in one aspect of perforating wallpaper.

In one aspect the invention provides a tool having one or more pairs of rotatably mounted opposed discs, the discs of each pair being spaced apart from one another and rotatable on axes inclined to one another relative to the direction of travel.

By mounting the discs in opposed pairs across a wallpaper perforating tool, with each disc capable of perforating the surface of the wallpaper, an improved tool can be provided which is easier to use, as the discs will not lift off the surface if the angle of the handle relative to the wall is varied. In addition, the tool is less likely to wander over the surface, as each pair of discs provides a compensating effect. The ability of this tool to accommodate itself to uneven surfaces, can be improved by mounting each disc or pair of discs independently.

These and other aspects of the invention will now be described by way of example only with reference to the following description of specific embodiments in conjunction with the accompanying drawings.

THE DRAWINGS

FIG. 2 is a side elevation of one of the modules showing a depth control adjustment.

FIG. 3 is an underside plan view of a module showing the inclination of the discs relative to the direction of travel.

FIG. 4 is a front elevation of a module showing the splay angle of the discs.

DETAILED DESCRIPTION OF THE INVENTION

Figure 1:
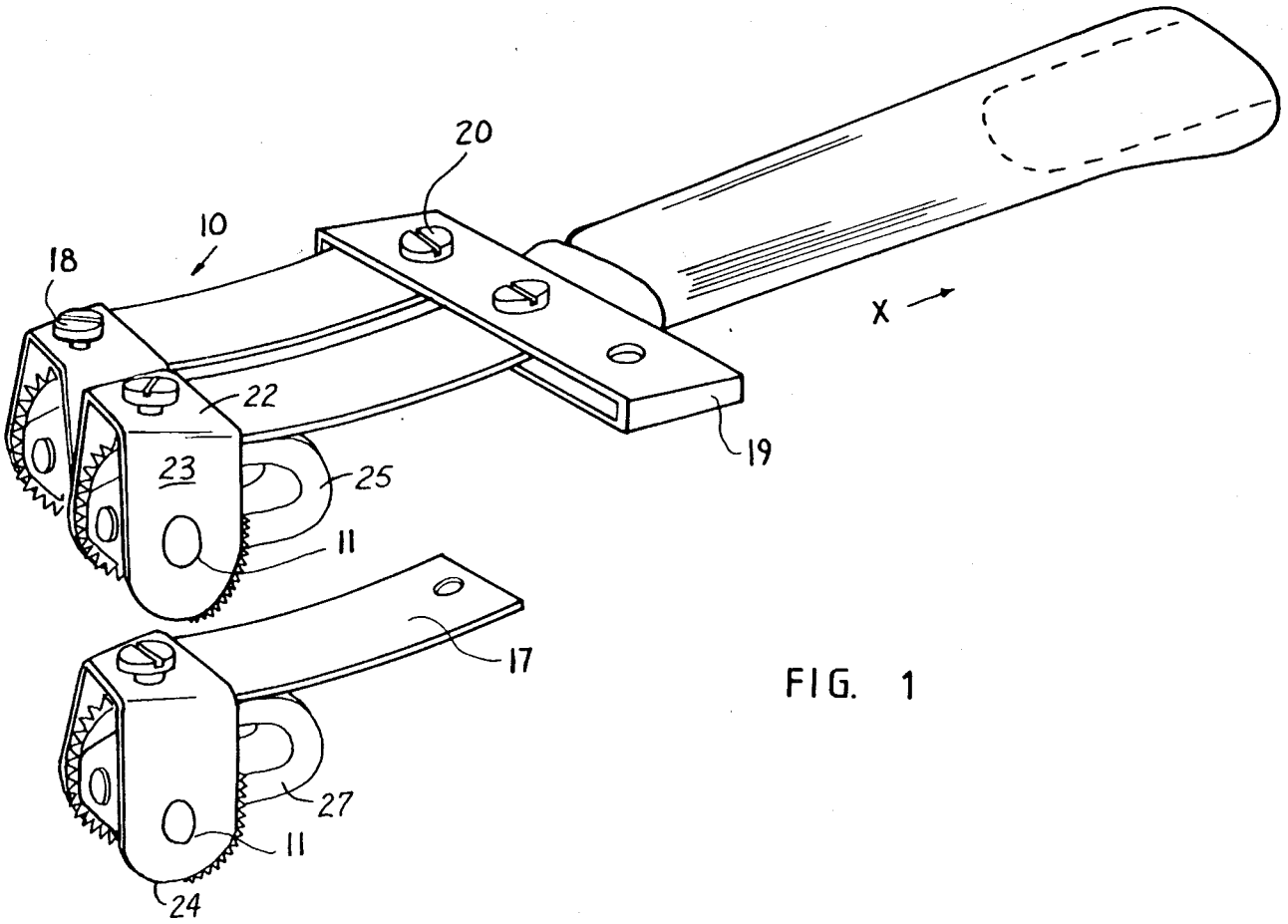
FIG. 1 illustrates a perspective view of a first wallpaper perforating tool, showing one of the modules removed from the tool.

A wallpaper perforating tool 10 has a plurality of modules 11, each module consisting of a pair of cutting discs 12, 13 mounted on axes inclined to one another. The inclination of these axes are best seen from FIG. 3. The axes 14, 15 are inclined to one another and the discs are inclined to the direction of travel at an acute angle "a". This gives a toe-out effect when the discs are moved by pulling the handle 16 in the direction of arrow X. Conversely, this can be regarded as a "toe-in" effect if the handle is pushed in the opposite direction.

Each module 11 is preferably mounted on a flexible member 17 integral with or attached at one end to the module by an appropriate fastener 18, and at the other end the flexible member can be integral with or attached by an appropriate fastener 20 to the cross-bar 19 of the tool. The tool shown in FIG. 1 has provision for three such modules, although it will be appreciated that the cross-bar 19 could be capable of receiving any number of flexible members, and hence any number of modules.

Each module consists of an inverted U-shaped member having a cross-piece 22 and downwardly depending side cheeks 23. The side cheeks are preferably splayed as shown in FIG. 4 to allow for the mounting of the discs in a splayed fashion. The bottoms of the side cheeks are preferably curved at 24 to enable the depth of the cutters to be controlled by pivoting the handle of the tool relative to the wall.

In addition, a depth control adjustment is provided by mounting the cutters on a resilient mounting 25, in the form of a U-shaped springy member 25, whose position relative to the bottom of the side cheeks can be varied by movement of a fastener, which is conveniently fastener 18, e.g. a screw which can be moved towards and away from the lower limb 27 of the resilient mounting 25.

By suitably shaping the modules and the flexible members 17, it is possible to provide an independent suspension for each of the pairs of discs, allowing for several degrees of freedom. For example, the flexible member 17 can flex up and down towards and away from a wall surface to accommodate unevenness in the surface of the wall. In addition, the combination of the flexible member and the module can allow for pivotal motion to enable the discs to pivot from side to side relative to the direction of travel. A further degree of freedom can be provided in the flexing of the flexible member about its own axis to provide for rocking of the discs from side to side. This allows for both up and down, rocking and castoring motion of the discs as they travel across a wall surface.

The discs can be formed of any convenient material, although for a wallpaper perforating tool it will be generally convenient to stamp or press the discs from sheet steel. If relatively sharp teeth are required, as is the case with a wallpaper perforating device, it will be generally convenient to bevel the edges of the discs before stamping out the teeth, as the combination of the bevelling and stamping produces relatively sharp points to the teeth without the need for a separate grinding step. The bevelled nature of these cutting discs is best seen from FIG. 4 where the combination of the bevelled edge and the splay angle allows the teeth of the cutting discs to bite into the surface of the wallpaper.

The discs are conveniently mounted at an angle "a" of 6 to 18 degrees to the direction of travel, and more preferably at an angle of 12 to 14 degrees to the direction of travel. The discs can be splayed at an angle "b" of about 8 degrees to the vertical as shown in FIG. 4, with a bevel angle of approximately 30 degrees.

Whilst the discs can be of any convenient size, discs of about 25 mm diameter are particularly suitable to achieve a spacing of about 22 mm between module centres. This enables the discs to be formed with desirable shape of teeth, resulting in a lightweight tool capable of working with confined spaces.

The combination of the bevelled teeth, the angle of the discs to the direction of travel and the splay angle enables the teeth to bite into the surface of the wallpaper as the tool is pulled down a wall. The teeth will tear the surface leaving inclined slots, with the torn portion of the paper protruding from the bottom end of the slots to act as a miniature dam for liquid applied to the surface of the paper. This enhances the supply per square centimeter of liquid or steam through the wallpaper to the adhesive layer.

By tilting the handle relative to the wall the spacing and angle between opposed teeth of a pair of cutters at the point of contact with the surface can be varied, thereby controlling the penetration of the teeth and hence the "aggression" of the discs. Lowering the handle towards the wall reduces the aggression of the discs whilst tilting the handle away from the wall increases the "aggression" of the discs.

The position of the maximum aggression angle can be chosen during manufacture by choosing appropriate disc angles. For example, a maximum aggression angle of about 60 degrees between the handle and the wall enables an operator to comfortably use the tool at an angle of about 30 degrees to the wall and to control the aggression of the discs by varying the handle between about 15 degrees and about 45 degrees. The shape of the wall contacting member for depth control can be chosen during manufacture to match the optimum range of user angles.

Figure 6:
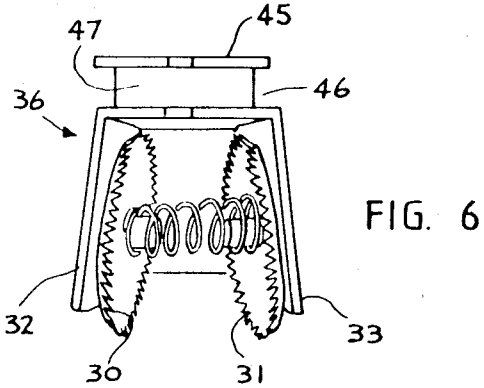
FIG. 6 shows a rear elevation of the module of FIG. 5.
Figure 5:
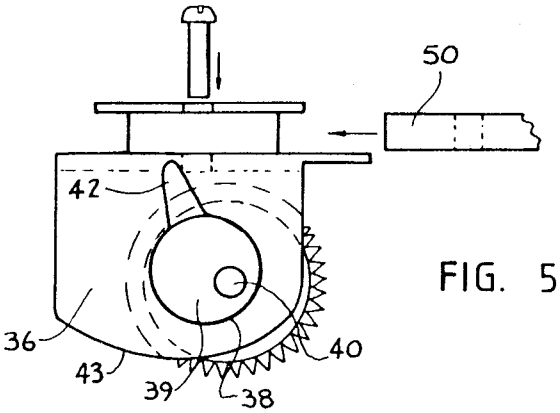
FIG. 5 shows an alternative module in side elevation.

Turning now to FIGS. 5 and 6, there is illustrated an alternative embodiment of a cutter module. This has a pair of cutter discs 30, 31 mounted within splayed sides 32, 33 of a module housing 36. This module housing preferably has apertures 38 in each side plate 32, 33 for the reception of a mounting button 39. Each mounting button has a stub axle 40 eccentrically mounted with respect to the aperture 38, and may be provided with a projection or lever 42 to rotate the button and thus control the position of the stub axle relative to the base 43 of the side plate.

Each cutter disc can be mounted on its respective stub axle, and the cutter discs are conveniently held in place by means of a spring 44 inserted over each stub axle to thus hold the cutter discs firmly in place.

The upper portion of the module is conveniently provided with a substantially rectangular plate 45 spaced apart from the main portion of the housing by sides 46 and leaving an opening 47 for the reception of a flexible finger or handle 50.

Figure 7:
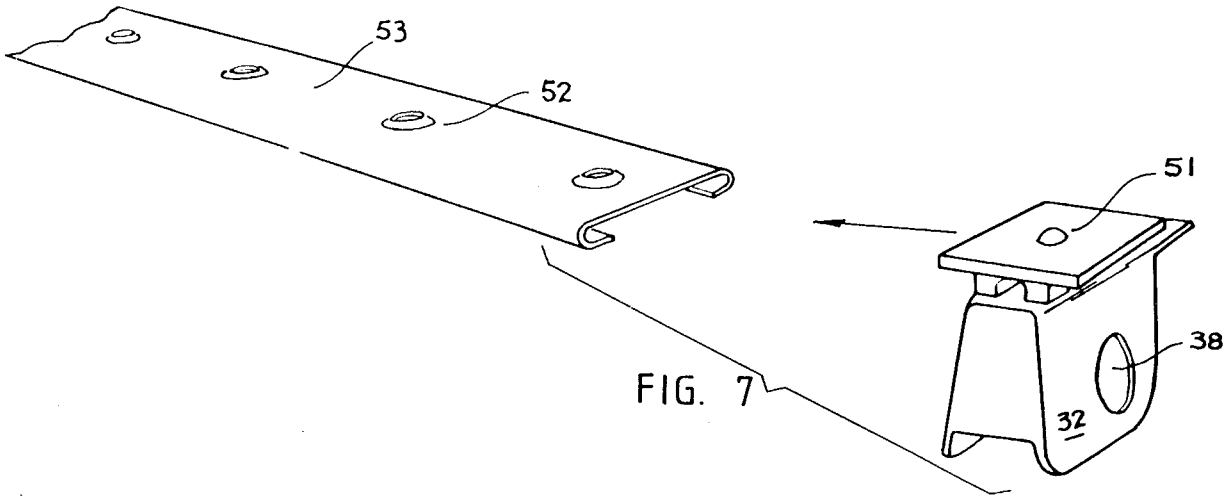
FIG. 7 illustrates a module with discs removed, the module being adapted to fit into a channel member.

By this mean, the module can be mounted on a flexible finger, or handle, or the modules can be mounted in parallel by sliding them into a channel member as shown in FIG. 7. The parallel arrangement of FIG. 7 can be achieved by providing a pimple, on the top of each module so that it will snap into an appropriate recess 52 on the channel member 53. By this means, each module can be provided with a limited amount of castoring action relative to the channel.

The mounting of the cutter discs on eccentrically mounted stub axles enables the depth of penetration of the cutters to be individually controlled by moving the levers 42 and hence moving the stub axles up and down relative to the bottom of the side plates thus controlling the depth of penetration of the cutters.

By providing a module housing with apertures 38 on the sides thereof, different cutter disc arrangements can be utilized. For example, in place of the eccentrically mounted stub axles, the discs could be mounted in a similar fashion to that shown in FIGS. 1 through 4, with the apertures in the side plates receiving a movable insert capable of moving up and down relative to the side plate to provide a wear-resistant skid which can project down below the position of the cutter discs. Thus instead of adjusting the cutter discs up and down relative to the side plate, an insert on the side plate can be adjusted up and down relative to the position of the cutters.

In use, the modules of FIGS. 5 and 6 enable the cutters to be mounted in the toe-out and splayed position, with the cutter discs capable of individual depth adjustment. Such cutter discs can be mounted on a simple tool having only one module and a handle, or can be combined in various combinations to provide a more complex tool having a plurality of modules mounted thereon, e.g. similar to the tool of FIG. 1.

Figure 8:
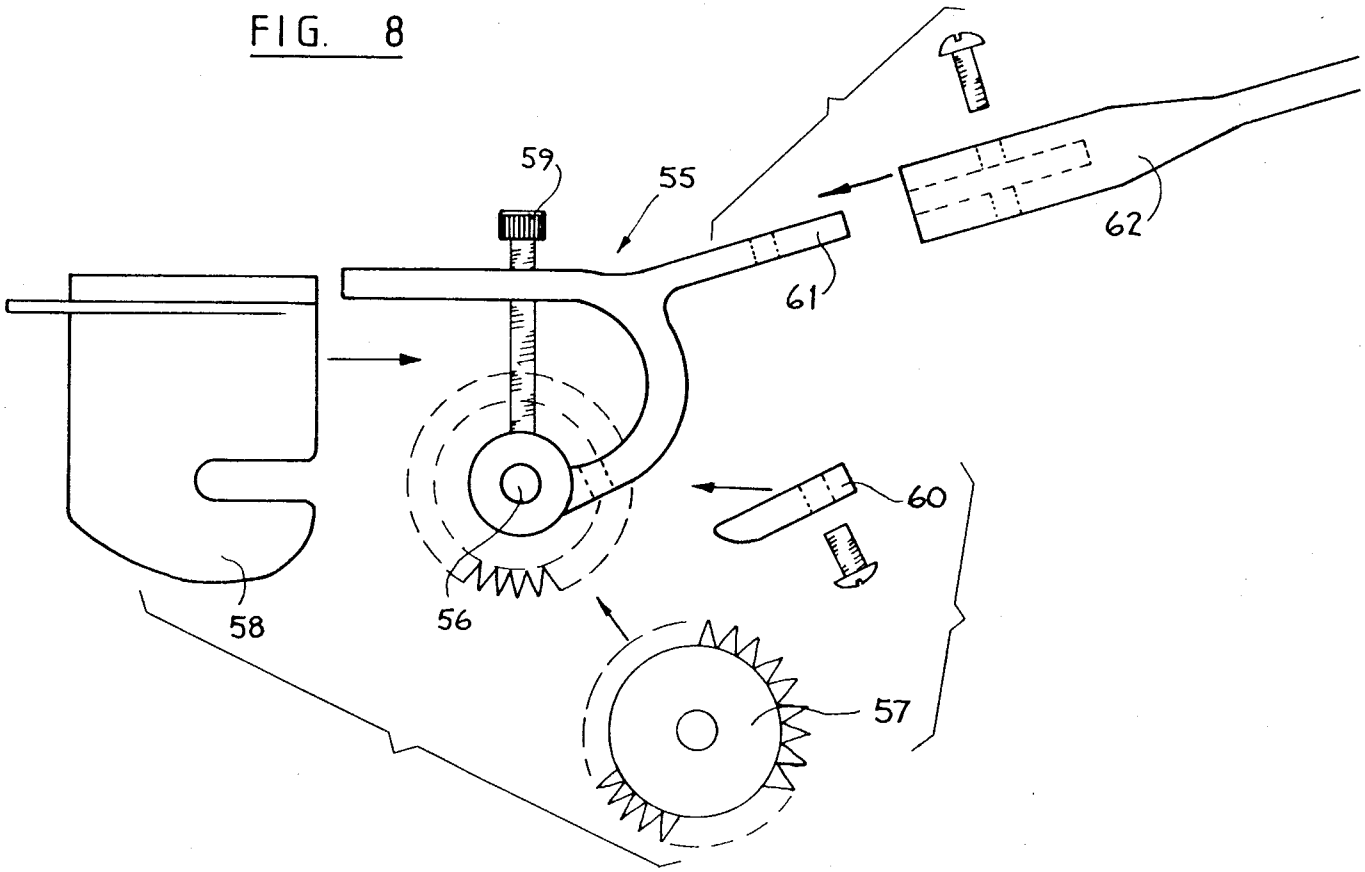
FIG. 8 shows an exploded view of a further module.

FIG. 8 shows a further module 55 having a pair of inclined axles 56 onto which cutter discs 57 can be mounted. In this arrangement the discs can be held in place by cover 58 which clips onto the module.

Depth control can be achieved by either moving the axles downwardly relative to the cover by screw 59 or by adjusting the position of a surface contacting member 60 attached to the underside of the module. An integral shank 61 can be attached to an individual handle or part of a tool shown by socket member 62.

By suitably forming the module and shank of a resilient material, the discs can accommodate themselves to irregularities in the surface onto which they are pressed.

Figure 9:
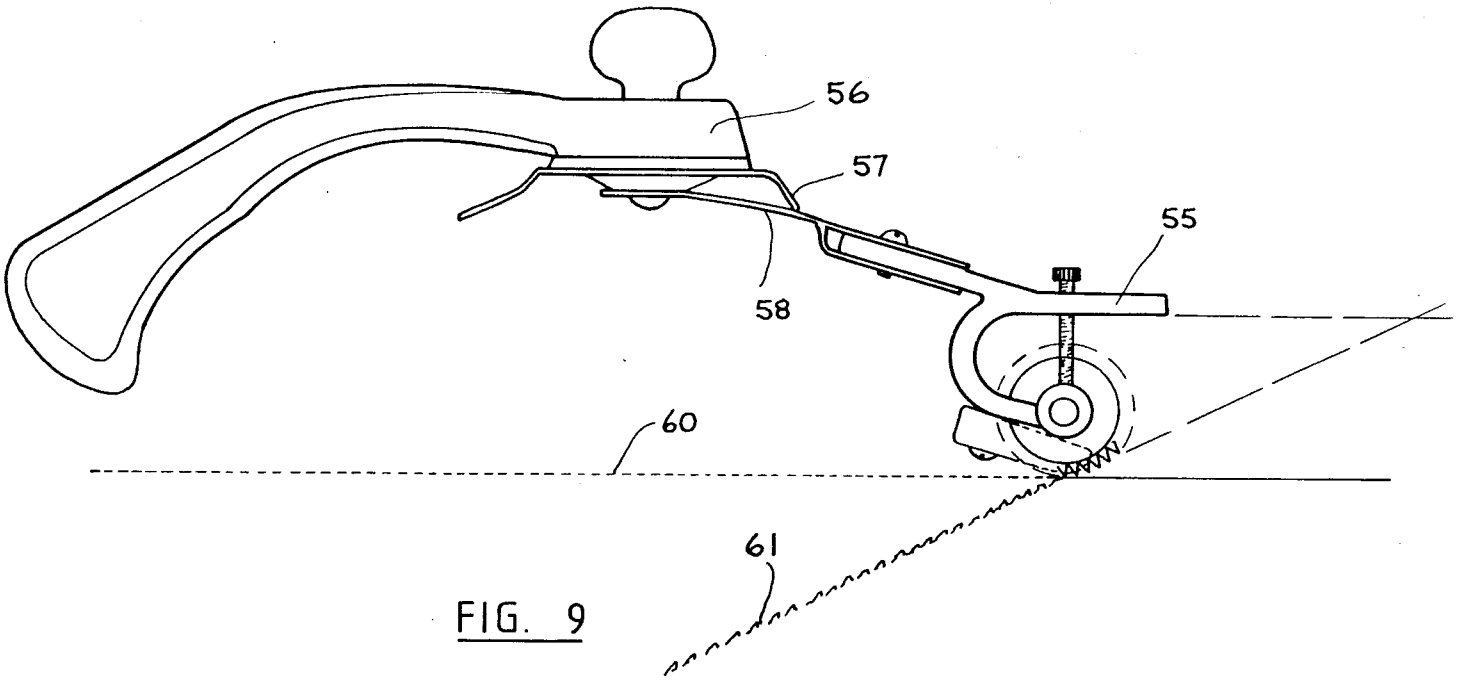
FIG. 9 is a side elevation of the module of FIG. 8 attached to a scraping tool.

FIG. 9 shows how modules 55 can be attached to a scraping tool 56 having a scraping blade 57 and a mounting plate 58 attached thereto.

Dotted line 60 shows the wall surface when the tool is held at a shallow angle to the wall reducing the aggression of the discs. Broken line 61 represents the wall surface when the tool is held at an increased angle to the wall thereby increasing the aggression of the discs.

Figure 10:
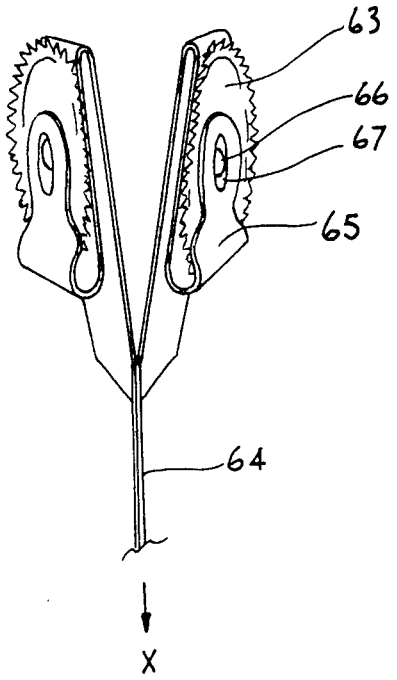
FIG. 10 is a top plan view of a pair of inclined discs.

FIG. 10 shows a top plan view of a pair of cutter discs 63 mounted so that they are inclined towards a shank portion 64. In this configuration the teeth are bevelled outwardly as the scarifying action provides an outward force as the discs move in the direction of arrow X.

The mounting can be formed from folded metal to provide a snap fit portion 65 with a pimple 66 and aperture 67 to hold the disc in place. The shank can be formed as a handle of an individual tool or as a component of a multiple disc tool.

Figure 12:
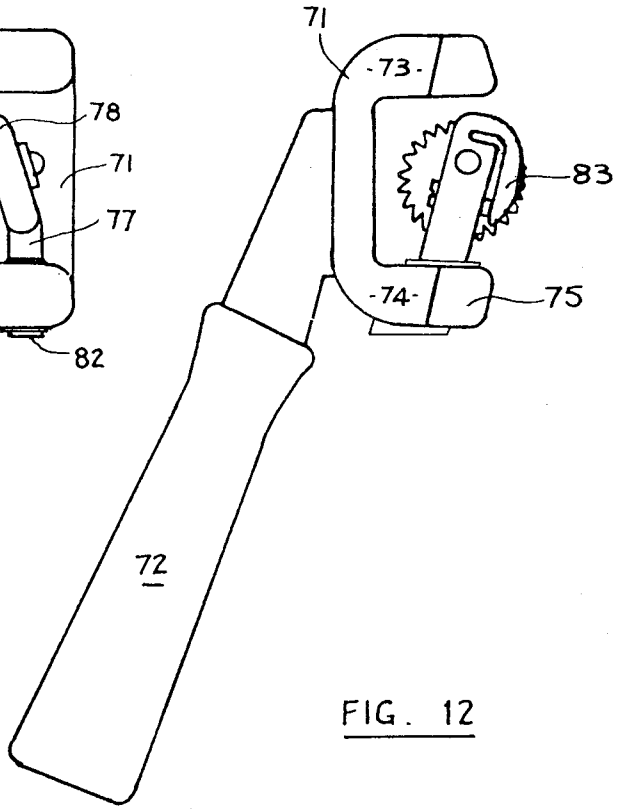
FIG. 12 is a side elevation of the tool of FIG. 11.
Figure 11:
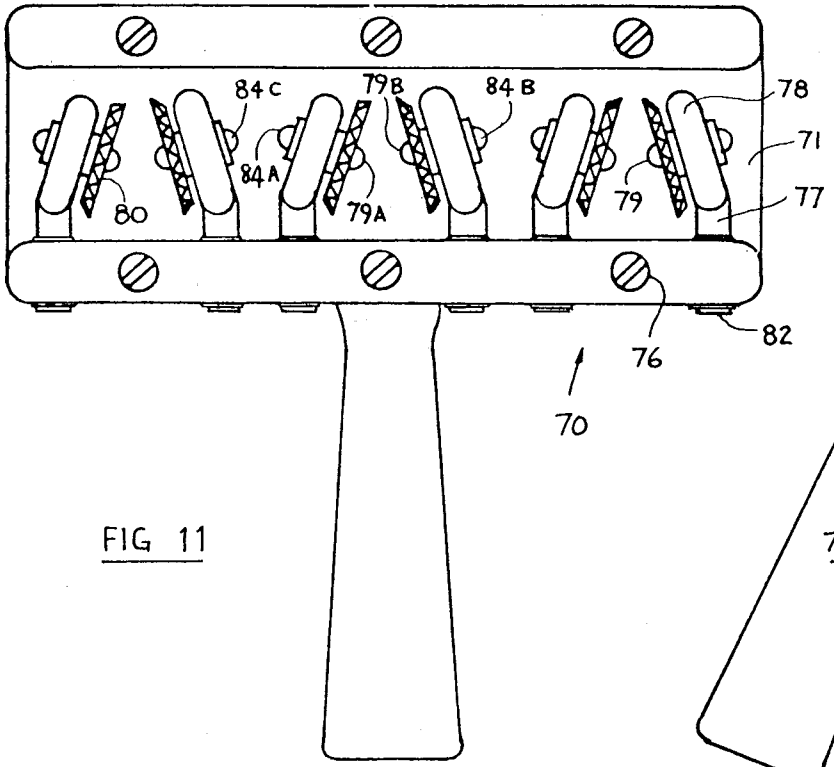
FIG. 11 is an underside plan view of a tool having pairs of discs mounted across the tool.

FIGS. 11 and 12 show a scarifying tool 70 having a channel member 71 to which a handle 72 is attached. The limbs 73,74 of the channel member are provided with clamping bars 75 attachable by fasteners 76. Each clamping bar and the limbs 73, 74 are provided with mating recesses which receive and clamp in place the legs 77 of disc mountings 78.

Each disc mounting has a stub axle 79 on which a cutting disc 80 is mounted by an appropriate fastener or by swaging the end of the axle to trap the disc in place.

The legs 77 are resiliently mounted by providing a resilient layer or sleeve 82 between the legs and the clamping portions of the limbs and clamping bars. This enables each cutter disc to compensate for surface irregularities as it is moved over a working surface.

Each disc can be provided with an adjustable depth control member 83 formed as part of the mounting 78.

The discs 80 are mounted in opposed pairs as previously described. The centres of these discs lie on a common line although each disc rotates on its own axis inclined to this common line. This enables the handle to be held at different angles relative to the wall without lifting the discs of the wall.

The channel member 71 can also be used with a second row of discs mounted on limb 73. In which case, the handle 72 is preferably replaced by a shorter handle or grip enabling the tool to be held flat against a wall in the manner of a scrubbing brush.

Additional discs could be mounted on the outer ends 84 of each stub axle so that discs mounted at 84A and 84B would constitute an opposed pair in addition to the discs mounted at 79A and 79B. Alternatively discs could be mounted in opposed pairs in positions such as 84A and 84C.

If desired, a supply of liquid can be provided in conjunction with the wallpaper scarifying tool. For example, a hollow handle may be provided containing a supply of water, or detergent, capable of soaking the wallpaper as it is perforated or scratched by the tool. Alternatively, the tool could be provided with a spray head and a supply tube from a liquid reservoir and pump so that liquid could be sprayed onto the wallpaper as it is perforated.

It will be appreciated that the tool can be modified to operate as an ice removing tool, for example for removing ice from a car windscreen. In which case, the discs are preferably adapted to perform a gripping and crushing function, rather than a perforating function. The discs can be formed of a hard plastics material, or can be formed of metal. In a preferred embodiment, the ice removing tool has a plurality of pairs of discs mounted in modules as previously described, with the outer discs being formed of plastics, and the inner discs of metal. Depth control means is provided to adjust the depth of the cutter discs relative to the skids or side plates.

The tool can be provided with a reservoir for a suitable liquid to assist in combating ice situations.

Removable discs enables different types of cutting discs to be used in the tool. The drawings illustrates sharply serrated discs, and different shapes of teeth can be chosen depending upon the shape and width of cut required. Instead of the sharply serrated discs illustrated in the drawings, the discs could be abrasive discs having their edges or peripheral flanges coated with an abrasive such as Tungsten Carbide. Discs could be mounted in a wobble configuration with pairs of discs inclined to one another and to the direction of travel but with the additional variation of wobbling about their main axis of rotation. Such a configuration is best suited to a module without side guards.

It is to be noted from the drawings that in all embodiments of the present invention, all the points of the teeth of all the discs lie on a common imaginary elliptical sheath. Also, it is to be noted from the drawings that there is an imaginary straight line on the surface to which the tool is applied, that passes through all of the circular paths described by the teeth on all of the discs.

Whilst various embodiments of the tool have been described, it will be appreciated that many other alterations or modifications may be made to the foregoing without departing from the scope of this invention as exemplified by the following claims.

I claim:

1. A hand tool for dislodging material from a surface to which it is adhered, comprising at least one pair of rotatably mounted opposed gripping discs with sharp teeth about their peripheries, the discs of each pair being spaced apart from each other and rotatable on axes angled relative to each other and to the direction of travel, all the points of the teeth of all the discs lying on a common imaginary elliptical sheath, the points of the teeth of each disc moving in a circular path upon rotation of the discs, whereby, in use, motion of the tool along a surface will cause all the discs to roll and to impart a sideways force on the surface.

2. A tool as claimed in claim 1, wherein the discs have bevelled edges.

3. A tool as claimed in claim 1, wherein each pair of discs are splayed with respect to the working surface.

4. A tool as claimed in claim 3, wherein a plurality of pairs of discs are mounted across the tool.

5. A tool as claimed in claim 1 wherein the discs are resiliently mounted to accommodate unevenness in the surface of said layer.

6. A tool as claimed in claim 5, wherein each pair of discs are mounted on resilient fingers.

7. A tool as claimed in claim 6, wherein each pair of discs are mounted on a removable module.

8. A tool as claimed in claim 1, including means for regulating the depth of penetration of the discs into said layer.

9. A tool as claimed in claim 8, wherein the discs are provided with a surface contacting member whereby the depth of penetration of the discs can be adjusted by moving the discs relative to the member.

10. A tool as claimed in claim 1, including a pair of discs mounted on a shank with the pair of discs and shank forming a Y-shaped configuration and the discs angled to the surface to impart an outwardly sideways force as the tool is pulled along a wall surface in the direction of the shank.

11. A hand tool as claimed in claim 1, there being an imaginary straight line on said surface that passes through all said circular paths and is perpendicular to the path of movement of said tool along said surface.

* * * * *